United States Patent [19]

Magnasco

[11] Patent Number: 4,574,417

[45] Date of Patent: Mar. 11, 1986

[54] SCRAPER

[76] Inventor: Peter L. Magnasco, 3052 Colonial Way, #11, San Jose, Calif. 95128

[21] Appl. No.: 667,114

[22] Filed: Oct. 30, 1984

[51] Int. Cl.[4] ..... A47L 13/08

[52] U.S. Cl. ..... 15/236 R; 30/172

[58] Field of Search ..... 15/236 R; 30/169, 172

[56] References Cited

U.S. PATENT DOCUMENTS

| | | | |
|---|---|---|---|
| 785,556 | 3/1905 | Kent | 30/172 |
| 2,484,476 | 10/1949 | Teigland | 30/172 |
| 2,546,577 | 3/1951 | Young | 15/236 R |
| 2,846,764 | 8/1958 | Hyneman | 30/172 |
| 4,490,879 | 1/1985 | Colby | 15/236 R X |

FOREIGN PATENT DOCUMENTS

| | | | |
|---|---|---|---|
| 355933 | 9/1961 | Switzerland | 30/172 |

*Primary Examiner*—Edward L. Roberts

*Attorney, Agent, or Firm*—Harvey B. Jacobson

[57] ABSTRACT

A horizontally elongated body is provided having opposite end portions and top and bottom sides. A pair of blade members are provided and blade support structure is supported from opposite end portions of the body and removably support the blade members therefrom with the blade members oppositely inclined downwardly and outwardly from the body opposite end portions. The blade members include bevelled end surfaces which are substantially coplanar and horizontally disposed. The blade members are subtantially rigid, but slightly flexive. The blade members extend beyond the body ends and sides to facilitate maximum working potential to perpendicular abutments and parallel objects. Also, the blade members, notwithstanding the body, are angled convergently upward toward each other from the work surface. It is this bi-angular blade concept that enables the scraper to function as a unit on a work surface.

8 Claims, 5 Drawing Figures

SCRAPER

BACKGROUND OF THE INVENTION

Various different forms of scrapers heretofore have been provided for the removal of surface coatings. When scraping surface coating such as paint, varnish and shellac, etc. from wood surfaces it is very important to maintain a scraper blade in substantially the same angle relative to the surface being scraped in order to prevent marring or gouging of the surface. Although persons experienced in furniture refinishing are able to maintain a scraper blade at a reasonably constant angle relative to the surface being scraped at least during initial scraping operations, even experienced persons encounter muscle fatigue during an extensive scraping operation and fatigued muscles render it very difficult for any person to perform precision work. Accordingly, a need exists for a scraper specifically constructed in a manner which will enable the scraping blade portion thereof to be maintained at a substantially constant angle relative to a surface being scraped.

Examples of various different forms of scrapers including some of the general structural and operational features of the instant invention are disclosed in U.S. Pat. Nos. 264,874; 785,556; 919,037; 1,895,961 and 2,818,642.

BRIEF DESCRIPTION OF THE INVENTION

The scraper of the instant invention includes a horizontally elongated "sanding block"-type body and blade support structure at opposite end portions of the body supporting a pair of blade members from the body with the blade members oppositely inclined downwardly and outwardly from opposite end portions of the body. The blade members extend beyond the body ends and sides and include bevelled lower end surfaces which are substantially coplanar and horizontally disposed. The blade members are substantially rigid, but slightly flexive.

By basic concept of design both blade members angle convergently upward constituting the sides of a triangle in relation to the work surface. The bevelled lower edges of the blades contact the workpiece with substantially equal downward pressure thereon, and in this represent the two corner points of a triangle upon the work surface. The body provides a grip as a means of operation of the scraper, and in essence acts to uphold the basic blade angle concept of the scraper as a unit.

In this manner constant blade working angles are maintained to afford ease of operation, protection of the work surface, and to preserve the bevelled cutting edges of the blades, as they perform on the work surface.

While one blade member is inclined to perform scraping in one direction of movement of the block, the other blade member is inclined to perform the desired scraping action in the other direction of movement of the block. In addition, when the block is moved in a direction with a first of the blade members inclined relative to the work to perform the desired scraping action the second blade member is oppositely inclined relative to the work and is disposed for sharpening of the bevelled end surface thereof. In this manner, the blades of the scraper are self-sharpened, to at least a reasonable degree, as the scraper is worked and thus specific blade sharpening operations are seldom required. Further, inasmuch as the bevelled end surfaces of the blade members are substantially coplanar and horizontally disposed, both blade members may be simultaneously sharpened to the correct bevelled angle merely by placing the scraper upon a plane sharpening surface such as a plate member having a sheet of emory paper or the like supported therefrom. The scraper is lightly moved over the surface of the emory paper in a circular motion in order to renew the bevelled end surfaces of the scraper blades in a precision manner.

The blade members are substantially rigid, but slightly flexive and in this manner trailing movement of a blade member during a scraping operation will abrade the leading edge of the bevelled end surface more and tend to hone the trailing edge thereof and thus tend to maintain the bevelled end surfaces of the blades sharpened at ever so slight upward convergent angles.

The main object of this invention is to provide a scraper which will enable even inexperienced persons to perform a satisfactory scraping operation.

Another object of this invention is to provide a scraper constructed in a manner such that the two blade members thereof will tend to be sharpened while the scraper is in use.

Yet another object of this invention is to provide a scraper constructed in a manner whereby the bevelled end surfaces of the blade members may be precision sharpened merely by utilizing a plane sharpening surface.

Still another object is to provide a scraper which prolongs the longevity of the blades by maintaining constant working and sharpening angles on the blades, thereby utilizing the blade material to the maximum.

A further object is to provide a scraper which will give an option in scraping up to, or away from a abutment or obstruction.

Another very important object of this invention is to provide a scraper which will greatly reduce the fatigue normally experienced by a person performing a scraping operation.

A further object of this invention is to provide a scraper including reversible scraping blade members.

A final object of this invention to be specifically enumerated herein is to provide a scraper in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
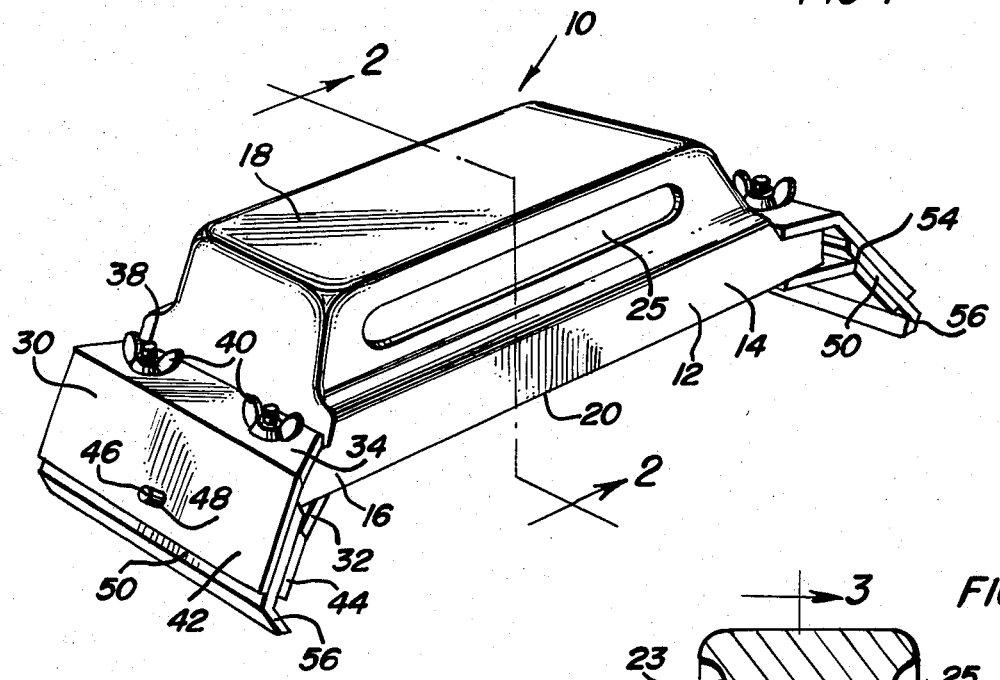
FIG. 1 is a perspective view of a scraper constructed in accordance with the present invention.
Figure 2:
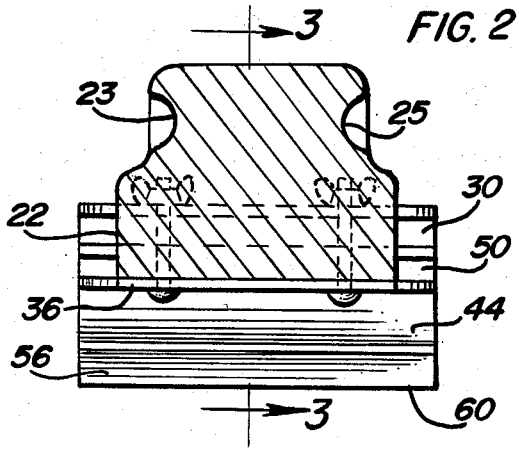
FIG. 2 is an enlarged transverse vertical sectional view taken substantially upon the plane indicated by the section line 2—2 of FIG. 1.
Figure 4:
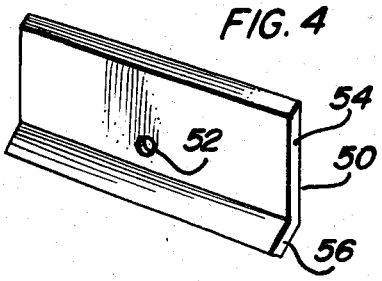
FIG. 4 is a perspective view of one of the blade members of the scraper.

Referring now more specifically to the drawings the numeral 10 generally designates the scraper of the instant invention. The scraper 10 includes an elongated body 12 having opposite end portions 14 and 16 as well as top and bottom surfaces 18 and 20 and opposite longitudinal sides 22 and 24. Further, the opposite sides 22 and 24 include thumb and finger receiving recesses 23 and 25, respectively.

The opposite end portions 14 and 16 define oppositely horizontally outwardly projecting mounting flange portions 26 each having a pair of opposite side upstanding bores 28 formed therethrough. Upper and lower angle members 30 and 32 include horizontal flange portions 34 and 36 removably clamp mounted to the upper and lower surfaces of the corresponding mounting flange portion 26 by threaded bolts 38 passed through the bores 28 and corresponding bores formed in the flange portions 34 and 36. The bolts 38 have wing nuts 40 threadedly engaged therewith. The upper and lower angle members 30 and 32 include downwardly and outwardly inclined flanges 42 and 44 which extend downwardly and outwardly from the corresponding body end portion in spaced parallel relation and each inclined flange 44 includes a single right angle upwardly and outwardly inclined locating pin 46 and the corresponding flange 42 includes a bore 48 formed therein through which the associated locating pin 46 is snugly received.

A blade member 50 is clamped between each pair of corresponding flanges 42 and 44 and includes a central bore 52 through which the associated pin 46 is snugly received. Each blade member 50 includes a first flange portion 54 in which the corresponding bore 52 is formed and a second flange portion 56 angulated between 45° and 60° relative to the flange portion 54. The flange portions 54 are inclined between 30° and 45° relative to the horizontal. The end edge 58 of the flange portion 54 is inclined between 50° and 45° relative to the flange portion 54 and the end edge 60 of the flange portion 56 is inclined substantially 75° relative to the flange portion 56.

When the blade members 50 are similarly mounted on opposite ends of the body 12 the edges 58 or 60 thereof are substantially coplanar. In this manner, the end edges 58 or 60 substantially parallel the work surface 62 to be scraped.

Figure 5:
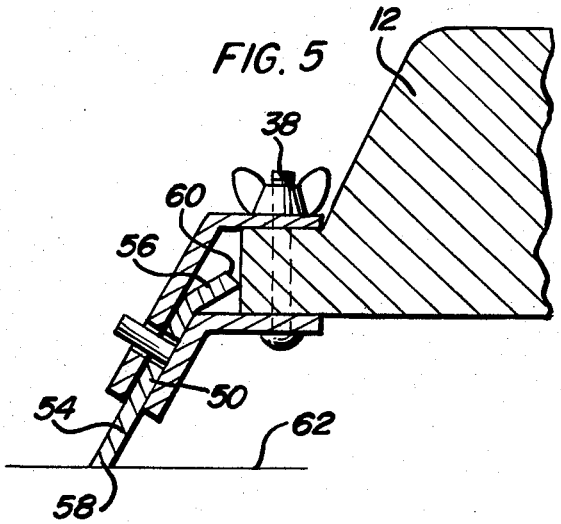
FIG. 5 is a fragmentary enlarged longitudinal vertical sectional view similar to FIG. 3 but illustrating the reversible blade member in a position reversed from the position thereof illustrated in FIG. 2.

In operation, with attention invited first to FIG. 5 of the drawings, when the body 12 is moved toward the left as viewed in FIG. 5 the leading blade member 50 performs the scraping function and resistance to forward movement of the lower edge 58 of the leading blade member 50 causes the first flange portion 54 thereof to flex slightly rearwardly thus inclining the end edge 58 slightly relative to the surface 62 in order that the desired scraping action may be performed. However, when the body member 12 is moved to the right as viewed in FIG. 5, the blade member 50 illustrated in FIG. 5 comprises the trailing blade member and is slightly flexed rearwardly in order that the heel portion of the end edge 58 will scrape across the surface 62 with the toe of the end edge 58 slightly elevated relative to the surface 62. In this manner, the heel of the end edge 58 is slightly abraded in a manner performing a sharpening action of the edge 58.

Figure 3:
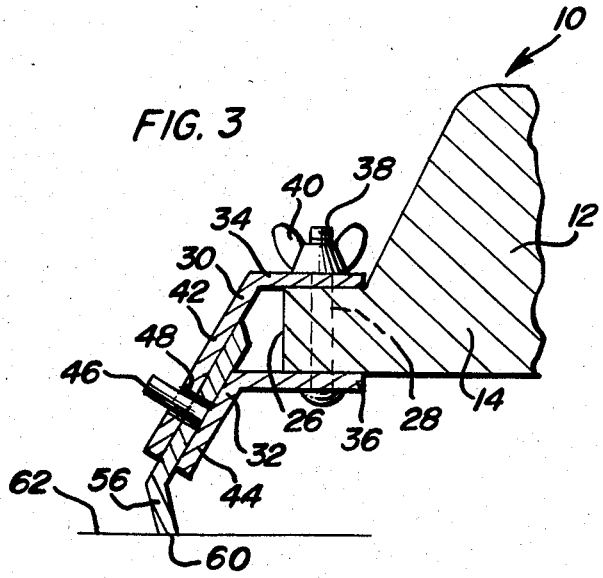
FIG. 3 is a fragmentary further enlarged longitudinal vertical sectional view taken substantially upon the plane indicated by the section line 3—3 of FIG. 2.

With attention now invited to FIG. 3, the second flange portion 56 and the end edge 60 performs the scraping action on the surface 62 and the end edge 60 performs the desired scraping action when the body 12 is moved to the right as viewed in FIG. 3 while the sharpening action of the surface 62 on the end edge 60 is performed on the heel of the end edge 60 when the body 12 is moved toward the left as viewed in FIG. 3.

From a comparison of FIGS. 3 and 5 of the drawings the manner in which the blade members 5 may be reversibly mounted will be readily apparent. Further, by utilizing a single locator pin 46, the blade members 50 may pivot slightly relative to the locating pin 46 and thus conform to the surface 62 being scraped, even though the body 12 may be slightly angularly displaced about its longitudinal axis relative to the surface 62.

Accordingly, it may be seen that the scraper 10 comprises a precision scraping implement which may be used even by inexperienced persons in performing a desired scraping operation. Further, the end edges 58 and 60 of the blade members 50 thereof are in effect self-sharpened while performing a scraping operation and the reversible blade members 50 enable the scraping ends thereof to be variably inclined relative to the surface 62, as desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scraper for controlled scraping of various different surfaces, said scraper including a horizontally elongated body having end portions and top and bottom sides, a pair of blade members, blade support means at opposite end portions of said body supporting said blade members therefrom with said blade members oppositely downwardly and outwardly inclined from said end portions, said blade members including bevelled end edge surfaces substantially coplanar and horizontally disposed, said blade members being substantially rigid but slightly flexive, said blade members including lower outer end portions angled slightly inwardly and downwardly and upon which said bevelled end edge surfaces are disposed.

2. The scraper of claim 1 wherein said blade support means on each end of said body include a pair of laterally spaced apart downwardly and outwardly inclined flanges between which the corresponding blade member is removably clampingly engaged.

3. A scraper for controlled scraping of various different surfaces, said scraper including a horizontally elongated body having end portions and top and bottom sides, a pair of blade members, blade support means at opposite end portions of said body supporting said blade members therefrom with said blade members, oppositely downwardly and outwardly inclined from said end portions, said blade members including bevelled end edge surfaces substantially coplanar and horizontally disposed, said blade members being substantially rigid but slightly flexive, said blade support means on each end of said body including a pair of laterally spaced apart downwardly and outwardly inclined flanges between which the corresponding blade member is removably clampingly engaged, at least one flange of each pair of flanges being removably supported from said body, a first flange of each pair of flanges including a single laterally outwardly projecting locator pin received through an opening provided therefor in the second flange of each pair of flanges, said blades each also having an opening format formed therein through which the corresponding pin is received, whereby said blade members may oscillate slightly about said pins.

4. A scraper for controlled scraping of various different surfaces, said scraper including a horizontally elongated body having end portions and top and bottom sides, a pair of blade members, blade support means at opposite end portions of said body supporting said blade members therefrom with said blade members oppositely downwardly and outwardly inclined from said end portions, said blade members including bevelled end edge surfaces substantially coplanar and horizontally disposed, said blade members being substantially rigid but slightly flexive, the opposite end portions of said body including endwise outwardly projecting mounting flange portions, said blade support means on each end of said body including a pair of laterally spaced apart downwardly and outwardly inclined flanges between which the corresponding blade member is removably clampingly engaged, each of said flanges including a horizontally directed upper end portion, the horizontally directed upper end portions of each pair of said flanges being disposed above and below the corresponding mounting flange portion of said body, said mounting flange portions and upper end portions including aligned bores formed therethrough, clamp screws removably secured through said registered bores, said blade members including lower outer end portions angled slightly inwardly and downwardly and upon which said bevelled end edge surfaces are disposed.

5. A scraper for controlled scraping of various different surfaces, said scraper including a pair of upstanding blade portions spaced along a straight horizontal path, disposed transverse to said path and positioned in general upward convergent relation, connecting means extending between and interconnecting upper portions of said blade portions, said blade portions being at least substantially rigid and supported relative to each other for slightly greater spreading apart of the lower edges thereof than said upper portions thereof responsive to downward manual force on said connecting means, the lower end edges of said blade portions being bevelled and substantially coplanar, said blade portions including lower extremities angled slightly inwardly and downwardly and upon which said bevelled lower end edges are disposed.

6. A scraper for controlled scraping of various different surfaces, said scraper including a horizontally elongated body having opposite end portions and top and bottom sides, one end of said body including a downwardly and outwardly inclined stiff but slightly flexive blade member including a lower end portion angled slightly inwardly and downwardly, the other end of said body substantially corresponding with the level of the lower extremity of said lower end portion and adapted to guidingly engage a surface to be scraped by said blade member lower extremity and to thereby retain both end portions of said body spaced constant distances from a surface to be scraped by said blade member lower extremity as said body is longitudinally reciprocally moved over a surface with said lower extremity and support structure engaged with said surface, said lower extremity including a bevelled end edge disposed in a horizontal plane substantially at which the lower extremity of said support structure terminates.

7. The scraper of claim 6 wherein said one end of said body includes blade support means supporting said blade member therefrom, said blade support means including a pair of laterally spaced apart downwardly and outwardly inclined flanges between which the upper end portion of said blade member is removably clampingly engaged.

8. The scraper of claim 7 wherein at least one flange of said pair of flanges is removably supported from said body, a first flange of said pair of flanges including a single laterally outwardly projecting locator pin received through an opening provided therefor in the second flange of said pair of flanges, said blade also having an opening formed through the upper end portion through which said pin is received, whereby said blade member may oscillate slightly about said pin.

* * * * *